US005372450A

United States Patent [19]

Blodgett

[11] Patent Number: 5,372,450

[45] Date of Patent: Dec. 13, 1994

[54] FLEXIBLE JOINT CONNECTOR

[76] Inventor: Douglas A. Blodgett, 4433 W. 149th St., Lawndale, Calif. 90260

[21] Appl. No.: 997,016

[22] Filed: Dec. 28, 1992

[51] Int. Cl.[5] ..... A63H 33/08

[52] U.S. Cl. ..... 403/407.1; 403/3; 403/171; 403/176; 403/291; 403/293; 403/294; 403/375; 403/408.1; 446/116; 446/118; 446/120

[58] Field of Search ..... 403/407.1, 408.1, 375, 403/295, 294, 293, 291, 176, 171, 3; 446/120, 116, 118

[56] References Cited

U.S. PATENT DOCUMENTS

| | | | |
|---|---|---|---|
| 687,789 | 12/1901 | Rhynedance | 403/294 |
| 1,034,499 | 8/1912 | Payne | 403/295 X |
| 2,534,716 | 12/1950 | Hudspeth et al. | 403/176 X |
| 3,264,021 | 8/1966 | Artman | 403/3 |
| 3,698,123 | 10/1972 | Heldt | 446/120 |
| 4,922,669 | 5/1990 | De Pas et al. | 403/176 X |
| 5,100,358 | 3/1992 | Volgger | 446/120 X |
| 5,104,125 | 4/1992 | Wilson | 446/120 X |

FOREIGN PATENT DOCUMENTS

| | | | |
|---|---|---|---|
| 2507134 | 9/1976 | Germany . | |
| 438121 | 11/1967 | Switzerland | 446/120 |

*Primary Examiner*—Randolph A. Reese
*Assistant Examiner*—Christopher J. Novosad
*Attorney, Agent, or Firm*—Roger A. Marrs

[57] ABSTRACT

An interlockable connection system is disclosed herein for releasably joining a selected number of tiles together wherein each tile includes a plurality of receptacles adapted to snap-lock with a retaining element used in common with other tiles so as to provide a composite object composed of multiple tiles of various polygonal shapes. The retaining elements may be of many shapes and tiles may be of a variety of geometric configurations. The connection system provides convenient repeatable joining and unjoining of the retaining elements with the tiles and permits rotation of the joint through a large angle about the axis of the joined tile edges.

1 Claim, 2 Drawing Sheets

FLEXIBLE JOINT CONNECTOR

BACKGROUND OF THE INVENTION

1. Field of the Invention

The present invention relates to the field of building elements, and more particularly to a novel assemblage of constructional elements in which various structures may be assembled together to produce a variety of building structures.

2. Brief Description of the Prior Art

In the past, it has been the conventional practice in the field of constructional elements to provide structural or decorative forms that may be erected by employing a variety of components which are joined together in an assembly to provide architectural structures, amusement structures, toys or the like. However, attempts have been made to expand the range of forms that may be erected by providing many different kinds and shapes of construction elements or parts. Usually, such an expansion results in increasing the cost of the construction and tends to restrict the imaginative use of the structure. Also, many structural elements or assemblies have been devised and marketed which usually consist of elongated elements connected by tubes or spheres to form an architectural structure or a replica of a machine or vehicle. Such prior elements are of great variety and many of such elements are fairly complex. Particularly, when considering connecting elements, manufacturing expense must be taken into account. Difficulties and problems have been encountered which stem largely from the fact that rapid wear of the elements is experienced so that after short term use, the parts are no longer frictionally tight and can no longer be reused.

Therefore, a long-standing need has existed to provide a novel structural or decorative form that may be assembled from a plurality of polygonal tiles that may be joined at respective adjacent edges by means of notches which permit connecting elements to be insertably snapped into the notches or receptacles so that a temporary but firm joint is provided between the tiles. The flexible joint connections are made easy to form and to separate repeatedly whereby an infinite number of structural combinations may be assembled.

SUMMARY OF THE INVENTION

Accordingly, the above problems and difficulties are overcome by the present invention which provides a novel flexible joint connector system whereby a plurality of tiles of varying geometrical shape can be joined together to form a structural form or decorative item. Each of the tiles includes an edge marginal region having a plurality of receptacles formed therein and wherein each receptacle includes an entrance of reduced diameter so as to accept a snap-lock relationship with a retaining element used in common with other tiles so as to provide a composite object. A feature of the invention resides in providing the connecting element from a variety of geometrical configurations and which when snap-lock connected with a receptacle provides a flexible joint which is firm but permits the joined tiles to be rotated about the axis of the joint.

Therefore, a primary object of the present invention is to provide a novel flexible joint construction for a plurality of tiles where any tile may be attached to any other tile because the tiles are not intrinsically male or female whereby the tiles may be of many shapes and can be attached to each other so that the geometry is not limited to only right angles.

Another object of the present invention is to provide a novel flexible joint system for an assembly of structures allowing endless geometric ideas to be rendered in physical form wherein it is possible to construct all five of the regular polyhedron and where they can be employed to build globes and geodesic domes.

Yet another object of the present invention is to provide a novel assembly of polygonal tiles that can be joined at their adjacent edges by snap-lock elements so as to provide a variety of polygonal shapes.

Still another object of the present invention is to provide a novel structure having flexible joint connections whereby the joints are convenient to form and to break apart repeatedly so as to make an infinite number of structural combinations.

Yet another object of the present invention is to provide a novel flexible joint connection system having the flexibility of existing building block products without the limitation of strictly rectangular geometry.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
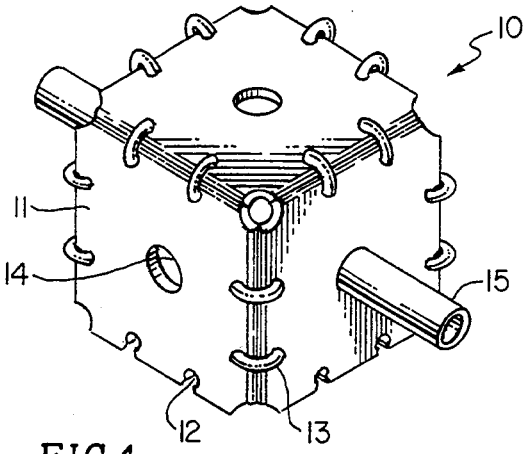
FIG. 1 is a front perspective view of a composite assembly of tiles using the novel flexible joint construction of the present invention.

Referring to FIG. 1, an assembled structure is illustrated in the general direction of arrow 10 which incorporates the flexible Joint construction of the present invention. In the embodiment shown, a cube is illustrated comprising a plurality of tiles, such as tile 11, which are arranged so that their adjacent edges are substantially parallel with respect to one another and wherein each of the tiles includes an edge marginal region having a pair of receptacles, such as receptacle 12 on tile 11, through which a retaining element, such as element 13, is snap-locked. It is noted that the retaining elements couple adjacent edge marginal regions of tiles together so that the resultant composite assembly is produced. The embodiment shown in FIG. 1 further illustrates that each of the tiles may include a central opening, such as opening 14, through which a rod may be inserted. The rod is indicated by numeral 15 and is illustrated assembled with tiles connected to the opposite edge marginal regions of tile 11 and the rod forms a part of the assembled construction. Furthermore, it is also to be noted that the corners of each of the respective tiles are provided with a semicircular cut, as indicated by numeral 16, so that when the adjacent tiles are coupled together by the retaining elements 13, the corners of three adjacent tiles provide an opening through which the rod 15 may be inserted and passed through the interior of the composite assembly to project through a similar hole on the other side or end of the composite structure 10. For purposes of illustration, the bottom of the composite structure 10 does not include a tile and therefore, no retainers are shown through the lower or bottom receptacles.

Figure 2:
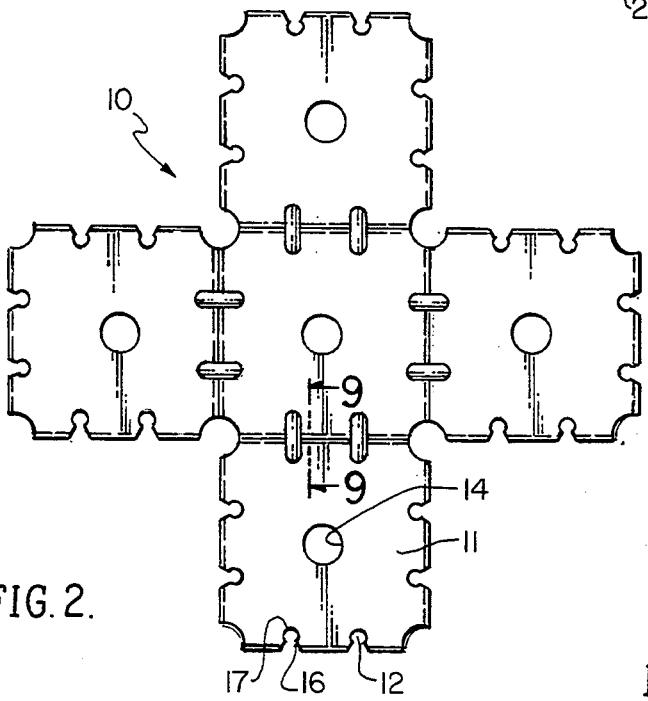
FIG. 2 is a plan view of the plurality of tiles used in the composite assembly of FIG. 1 preparatory to final assembly.
Figure 9:
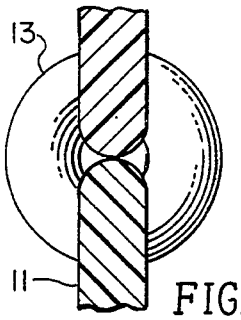
FIG. 9 is an enlarged sectional view showing adjacent edge marginal regions of tiles joined by a retainer or connecting element.
Figure 10:
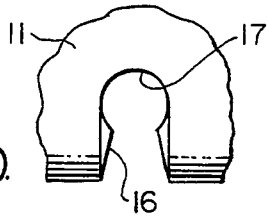
FIG. 10 is an enlarged front fragmentary view of a notched receptacle having a reduced entrance leading into a retaining opening.

Referring now in detail to FIG. 2, the composite structure 10 is illustrated in a position preparatory for joining additional sides of the respective tiles together to form the cube shown in FIG. 1. In this connection, the tiles are shown in a laid-out pattern and the respective edge marginal regions are joined together by retaining elements preparatory for moving the respective tiles into the cube configuration so that additional retaining elements can be included to maintain the cube shape.

It is to be particularly noted that the edge marginal region of each tile, such as tile 11, includes a pair of receptacles, such as receptacle 12, wherein the receptacle takes the form of an opening having a reduced entrance, such as the tapered entrance 16 leading into opening 17 adjacent to the receptacle 12. Therefore, it can be seen that the retaining element 13 is introduced through the reduced opening 16 into the receptacle opening 17. This is a snap-lock relationship whereby the retaining elements may easily be forcibly urged through the reduced entrance into the enlarged opening 17 in a snap-lock manner. Conversely, the retaining element 13 can be withdrawn from the receptacle by exerting a force which would urge the retaining element out of the opening 17 through the reduced entrance 16. FIG. 2 also illustrates the provision for a central opening 14 in each of the respective tiles and that the corners include a semicircular cut so as to accommodate rod 15, if desired.

Figure 3:
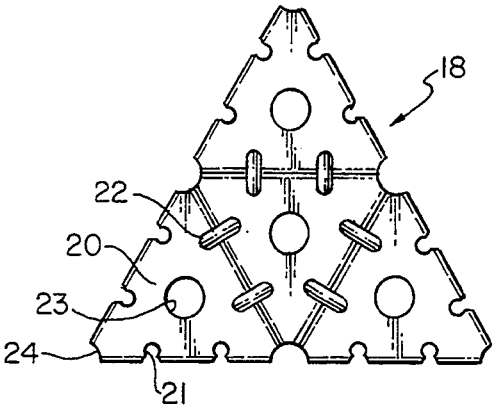
FIG. 3 is a plan view of another assembled construction employing the flexible joint system of the present invention.

FIG. 3 is a front plan view of tiles having a different geometric configuration, notably that of a triangle, laid out in a pattern preparatory for being folded into a triangular structure. When the tiles indicated in the general direction of arrow 18 are folded over upon themselves, the triangular structure is produced and additional retaining elements can be introduced into corresponding receptacles. Numeral 20 indicates one of the tiles of triangular configuration and numeral 21 illustrates a typical receptacle which is carried along the edge marginal regions of each tile. Numeral 22 illustrates the joining retaining element, and numeral 23 illustrates a central hole for receiving a rod 15, if desired. As previously described, the respective corners or terminal points of the triangular tiles 20 are provided with semicircular cuts, as indicated by numeral 24, so that a circular opening is provided for receiving the rod 15, if desired.

Figure 4:
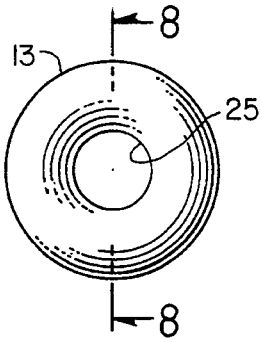
FIG. 4 is an enlarged side elevational view of a connecting element used in joining adjacent edges of tiles shown in FIGS. 1 and 3 respectively.
Figure 5:
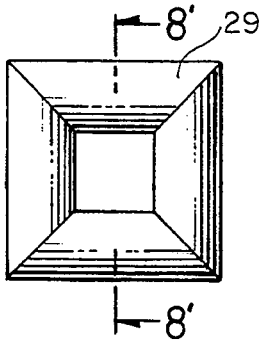
FIG. 5 is a side elevational view of another embodiment of a connecting element useful in joining tiles together.
Figure 6:
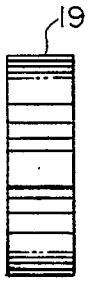
FIG. 6 is an end elevational view of a connector alternative illustrating the flatness of its sides.
Figure 7:
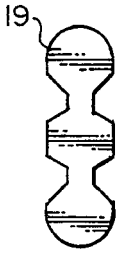
FIG. 7 is a cross-sectional view of the connector shown in FIG. 6.
Figure 8:
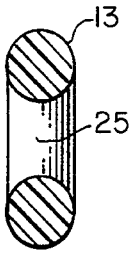
FIG. 8 is a transverse cross-sectional view of the connector shown in FIG. 4 in the direction of arrows 8—8 and represents a similar transverse cross-sectional view of the alternate connector shown in FIG. 5 in the direction of arrows 8'—8'.

Referring now to FIG. 4, a typical retaining element 13 is illustrated in which the overall configuration is that of a toroid having a central opening 25. The thickness of the retaining element is sufficient to require forcible urging through the receptacles 12 or 21 into the inner receptacle opening. The reduced opening will partially occupy the central opening 25 of each retaining element once installed. FIG. 8 illustrates a transverse cross-sectional view of the toroid retaining element 13. However, FIGS. 6 and 7 illustrate another form of retaining element which is not round but is flat so that when engaged in the tile, it is flush with the face of the tile. FIG. 5 is still another retaining element and has a similar cross-sectional view as that of the toroid shown in FIG. 4, and the cross-section is shown in FIG. 8 as taken in the direction of arrows 8'—8' in FIG. 5.

Figure 11:
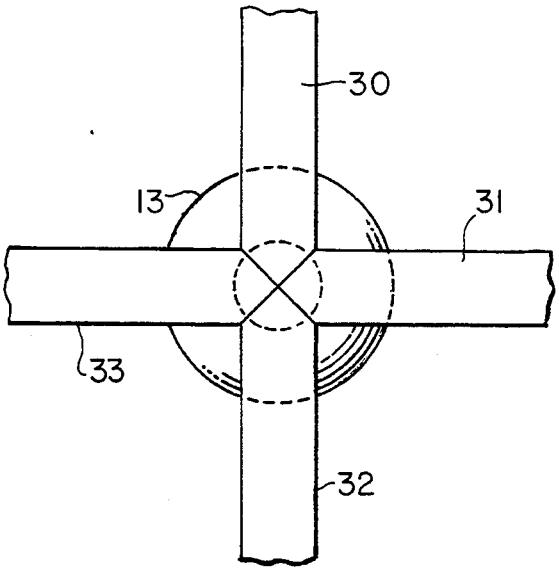
FIG. 11 is a diagrammatic view showing at least four tiles joined together by a single connecting element so as to be in a non-rotating position.

Referring now in detail to FIG. 11, it can be seen that the retaining element 13 connects the edge marginal regions of tiles 30, 31, 32 and 33 which may be identical to the tiles shown in FIG. 1. However, the adjacent terminating ends of the respective tiles form converging edges so that when the four tiles are placed together, no substantial movement is permitted within the respective tiles since the conformal surfaces of the wedged ends fits together into a solid assembly.

Figure 12:
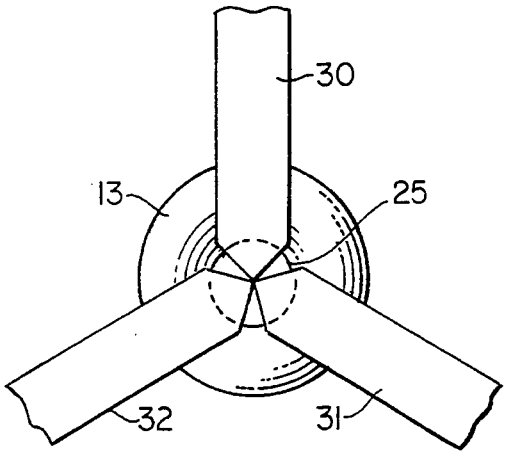
FIG. 12 is a view similar to the view of FIG. 11 illustrating three tiles connected by a connector element permitting rotation about a connecting point forming the axis of rotation.

With respect to FIG. 12, it can be seen that tiles 30, 31 and 32 are held together by the retaining element 13 but in a loose manner since the wedge-shaped edge marginal regions of the respective tiles do not form a solid connection whereby the tiles may rotate about a common axis running through the opening 25 of the retaining element 13.

Figure 13:
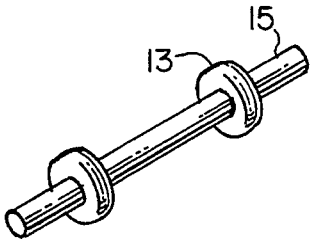
FIG. 13 is a perspective view showing that the connecting elements may be carried on a rod preparatory for joining with the edge marginal regions of tiles.
Figure 14:
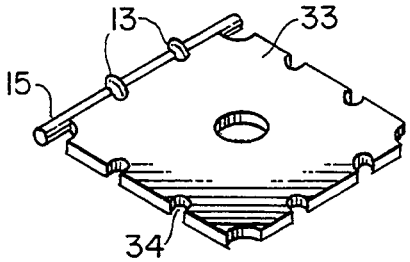
FIG. 14 is a view similar to the view of FIG. 11 showing a tile snap-locked with the connectors carried by the rod.
Figure 15:
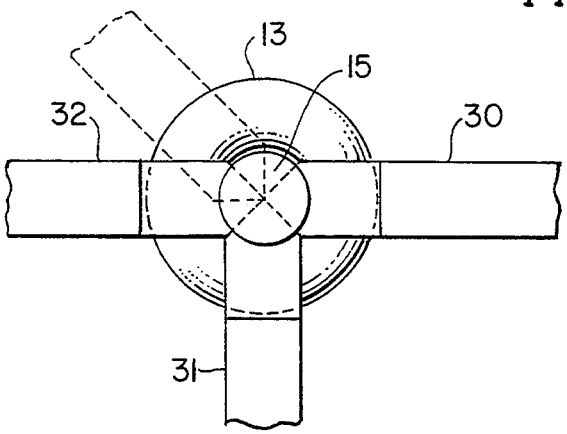
FIG. 15 illustrates flexibility of the tiles connected by the connecting element about respective axes at the edge of the respective tiles.

Referring now in detail to FIGS. 13, 14 and 15, another connecting arrangement is illustrated whereby the respective retaining elements 13 may be carried on the rod 15 and the body of each of the retaining elements may be pressed into receptacles of a respective tile. The tile is indicated by numeral 33 and a typical receptacle is indicated by numeral 34.

In view of the foregoing, it can be seen that many tiles can be assembled in the manner described above to make complex three-dimensional assemblies. Holes in the center of each face of a tile allows rods to be passed through. Rounded corners of each tile allow for connecting assemblies corner-to-corner. Thus, assemblies can be attached to each other at the corner, edge or face. Any tile may be attached to any other tile because the tiles are not intrinsically male or female. The tiles may be of any desired geometrical shape and can be attached to each other so the geometry is not limited to only right angles. The versatility of the tile with its joining system allows endless geometric ideas to be rendered in physical form. For example, it is possible to construct all five of the regular polyhedron. Also, the tile and joining system can be used to build globes and geodesic domes.

The tiles are polygons which can be joined at their adjacent edge marginal regions via the retaining elements and the receptacles in a snap-lock manner. The joint achieved is firm but flexible and the joined tiles can be rotated at the axis of the joint. The retaining elements snap into holes or receptacles along the edge of the tiles and the retaining elements project from the edge of the tile so other tiles can be attached. The tiles are held together firmly and can be rotated about the axis of the joint.

Therefore, the joints once formed allow free rotation of the tiles about the axis formed by the joint and polygons of various numbers of edges can be joined to each other. Several tiles can be combined to form three-dimensional objects and multiple tiles can share an edge with as many retaining elements as desired. The joints are easy to form and break away repeatedly to make an indefinite number of combinations.

The system of the present invention is intended to join the adjacent edges of two flat objects, such as the tiles illustrated. The system allows for easy joining and unjoining of the tiles in a repeated manner with little wear or resistance. It also allows rotation of the joint through a large angle about the axis of the joint edges. The system consists of a series of holes or slots along each edge marginal region of a tile to be joined with another tile. The slotted holes allow a flexible retaining element or ring to snap through the reduced entrance of the slot into a receptacle hole. Each hole is at a distance away from the edge that leaves enough of the retaining element or ring exposed to fit into a hole in another tile. The edge of each object is beveled to allow the joint to be made at any angle.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed:

1. In a joint connecting system for releasably and movably coupling polygonal tiles together in a particular polyhedral structure, the combination comprising:

at least two polygonal tiles, each tile having peripheral edge marginal regions adapted to be moved adjacent to one another to provide said polyhedral structure;

each of said tile edge marginal regions having at least two notched receptacles with each receptacle provided with a converging tapered open entrance leading into a retaining opening;

said tapered open entrance constituting a reduced opening of lesser dimension than said retaining opening;

a retainer element having opposite sides of a given dimension greater than said reduced opening dimension so as to provide a yieldable snap-lock interference fit therethrough into said retaining opening of opposing respective notched receptacles;

said retainer element is a toroid having an open ended passage opening on opposite sides thereof for receiving said reduced opening of said notched receptacles.

* * * * *